US005895561A

United States Patent [19]

George

[11] Patent Number: 5,895,561

[45] Date of Patent: Apr. 20, 1999

[54] METHOD OF SEALING COOLING BLOCKS USING ELECTRODEPOSITED METAL

[75] Inventor: David B. George, Salt Lake City, Utah

[73] Assignee: Kennecott Utah Copper Corporation, Magna, Utah

[21] Appl. No.: 08/782,958

[22] Filed: Jan. 13, 1997

Related U.S. Application Data

[60] Provisional application No. 60/010,096, Jan. 17, 1996.

[51] Int. Cl.[6] ..... C25D 5/02

[52] U.S. Cl. ..... 205/114; 205/115; 205/122

[58] Field of Search ..... 205/114, 115, 205/122

[56] References Cited

U.S. PATENT DOCUMENTS

| | | | |
|---|---|---|---|
| 299,055 | 5/1884 | Collins | 205/114 |
| 901,115 | 10/1908 | Metten | 205/114 |
| 2,603,593 | 7/1952 | Blickensderfer | 205/114 X |
| 3,310,851 | 3/1967 | Stiteler | 22/85 |
| 3,540,627 | 11/1970 | Armstead | 222/146 |
| 3,554,490 | 1/1971 | Cahoon | 251/356 |
| 3,639,215 | 2/1972 | Van Sciver, II et al. | 205/114 |
| 3,692,637 | 9/1972 | Dederra et al. | 205/114 |
| 4,155,492 | 5/1979 | Seaton | 222/592 |
| 4,508,247 | 4/1985 | Mills et al. | 222/598 |
| 4,661,153 | 4/1987 | Sinha | 75/76 |
| 4,696,723 | 9/1987 | Bosquet et al. | 205/115 |
| 4,946,083 | 8/1990 | Fishler et al. | 222/602 |
| 4,984,769 | 1/1991 | Brückner et al. | 266/44 |
| 5,024,422 | 6/1991 | Fishler et al. | 266/272 |
| 5,058,864 | 10/1991 | Molenaar et al. | 266/45 |

OTHER PUBLICATIONS

F.A. Lowenheim, *Electroplating*, McGraw–Hill Book Co., New York, 1978, pp. 198–201.

*Primary Examiner*—Kathryn Gorgos
*Assistant Examiner*—William T. Leader
*Attorney, Agent, or Firm*—Whyte Hirschboeck Dudek SC

[57] ABSTRACT

Metal, e.g. copper, is electrolytically deposited within the recess formed over a plugged hole of a component of a pyrometallurgical vessel, e.g. a cooling block, to form a seamless seal with the surface of the component. The method comprises the steps of inserting a mechanical plug into a channel opening of the component such that a recess is formed between the external surface of the plug and the outer surface of the component; positioning an anode adjacent the recess; providing an aqueous solution containing metallic ions, e.g. a solution of copper sulfate, between the anode and the mechanical plug; and creating an electric potential across the anode and the mechanical plug such that metal is deposited within the recess, preferably until the recess is filled with the electrodeposited metal. In alternative embodiments, the process can be used to secure fittings and the like to the components or to repair ruptured or weakened areas along the perimeter of such fittings.

5 Claims, 2 Drawing Sheets

METHOD OF SEALING COOLING BLOCKS USING ELECTRODEPOSITED METAL

This Application claims the benefit of U.S. Provisional Application No. 60/010,096, filed Jan. 17, 1996.

BACKGROUND OF THE INVENTION

This invention relates generally to pyrometallurgy, and specifically to a method for sealing holes or channels drilled in cooling blocks used in pyrometallurgical furnaces In the pyrometallurgy of copper, as well as many other metals, furnaces of various designs are used for a number of processes including smelting ore and or concentrates, converting matte and fire-refining metal. In many cases, these furnaces are equipped with cooling blocks. Cooling blocks are used to moderate the furnace temperature to achieve various ends, such as prolonging refractory life or assisting in the introduction or removal of various materials from the furnace.

Cooling blocks are constructed typically of cast copper. These blocks often contain internal channels or conduits through which a cooling medium can be circulated to assist in regulating the temperature of the furnace. These channels within the cooling blocks are formed generally either during the casting procedure or through a drilling operation. Combining these two procedures is also common, such that some of the channels are formed by casting and other channels, typically the channels interconnecting the cast channels, are formed by drilling. For example, a cooling block might be cast with a number of horizontal channels extending into the cooling block and running parallel to one another. Vertical channels can then be drilled perpendicular to these horizontal channels to interconnect and establish fluid communication between the channels. In another example, intersecting horizontal and vertical holes are drilled completely through the block and once interconnected, the open ends of the channels are plugged or sealed.

Regardless of the method by which the channels are formed, typically at least one plug is necessary to seal unwanted entry holes into the cooling block such that the flow integrity of the internal cooling channels is maintained. Failure to properly plug these entry holes can result in leakage of the cooling fluid. In the past, mechanical plugs have been used to seal these holes. Typically a metal plug is inserted into an undesired hole so that the top of the plug is flush with the external surface of the cooling block. Once positioned within the hole, the plug is then welded into place to serve as a seal against cooling fluid leakage.

There are several disadvantages in the process of plugging holes in the above-described manner. First, welding is undesirable because surface contaminants can result in a lack of bonding and lead to gas porosity. Because the coolant circulating within the channels may be under pressure, a poor bond or a porous weld yielding a weak joint can result in a blowout of the plug. Additionally, these types of welds result in a bead such that the surface of the cooling block does not have a smooth finish. However, machining the weld bead to produce a smooth surface is undesirable because this would weaken the integrity of the weld.

Another disadvantage with the plugging process of the prior art is that the junction of the plug and the cooling block forms a seam. Seams are undesirable because they typically result in leaks, especially when the sealed plug in question is under pressure.

Welds such as those described above are also commonly used to secure pipe fittings and the like to cooling blocks.

Typically, a fitting is threaded to be received by the correspondingly threaded internal diameter of a channel. However, these threads alone generally do not provide the sufficient mechanical strength to secure such fittings. Therefore, additional means are often necessary for securing the fitting within the channel. In the past, a simple weld at the joint between the fitting and the cooling block has been utilized. However, welds such as these are also subject to the problems described above. Additionally, these types of welds can damage the integrity of the fitting, causing leaks in the fitting at the point of the weld.

One known method of repairing holes or weak points that do develop in such fittings, either at their point of attachment to a cooling block or elsewhere along the perimeter of the fittings, is to secure a jacket over the damaged portion of the fittings. These jackets are typically secured by welding or other mechanical means such as clamping. However, this method of addressing damaged fittings is undesirable because the damaged areas are not repaired but only temporarily mended. Specifically, the ruptured (or weak) area is not sealed (or reinforced) in any way, but only covered such that this method is only temporary in nature. As a result, over time leaking fluid tends to migrate along the outer surface of the fittings, underneath the jacket, until leaks appear along the joint between the jacket and the fitting.

As is evident from the preceding discussion, a need exists for an economical and inexpensive process which can provide a seamless seal for plugging holes in cooling blocks. The process should yield a plug which is less pressure sensitive than the process of the prior art. Moreover, desirably this process should also be useful for securing pipe fittings and the like to such cooling blocks to provide a strong mechanical bond without damaging the fittings. Still, further, the process should be able to repair ruptured or weakened areas in fittings.

SUMMARY OF THE INVENTION

In accordance with this invention, a mechanical plug is inserted into a channel opening such that the plug is recessed below the surface of a copper cooling block. Copper is electrolytically deposited within the recess over the plug to form a seamless seal with the surface of the cooling block. Specifically, the process utilizes the mechanical plug as a cathode. An anode is positioned adjacent the opening and the portion of the block containing the opening is immersed in an aqueous solution containing copper ions. A potential across the anode and the cathode, i.e., the mechanical plug, is created such that copper is deposited on the external surface of the plug. The electrodepositing process is continued until the recess is filled, thus forming a seamless seal with the copper body of the cooling block.

In another embodiment, the above described electrodepositing process is used to join pipe fittings and the like to cooling blocks such that a seamless seal is formed between the pipe fittings and the cooling blocks without damaging the integrity of the fittings.

In yet another embodiment, the above described electrodepositing method is used to repair ruptured or weak fittings by depositing material over the damaged area to form a seamless bond around the damaged area.

DESCRIPTION OF THE PREFERRED EMBODIMENTS

In the detailed description of this invention, like numerals are employed to designate like parts throughout the same. Various items of equipment, such as fasteners, fittings, etc., are omitted so as to simplify the description. However, those skilled in the art will realize that such conventional equipment can be employed as desired.

Figure 1:
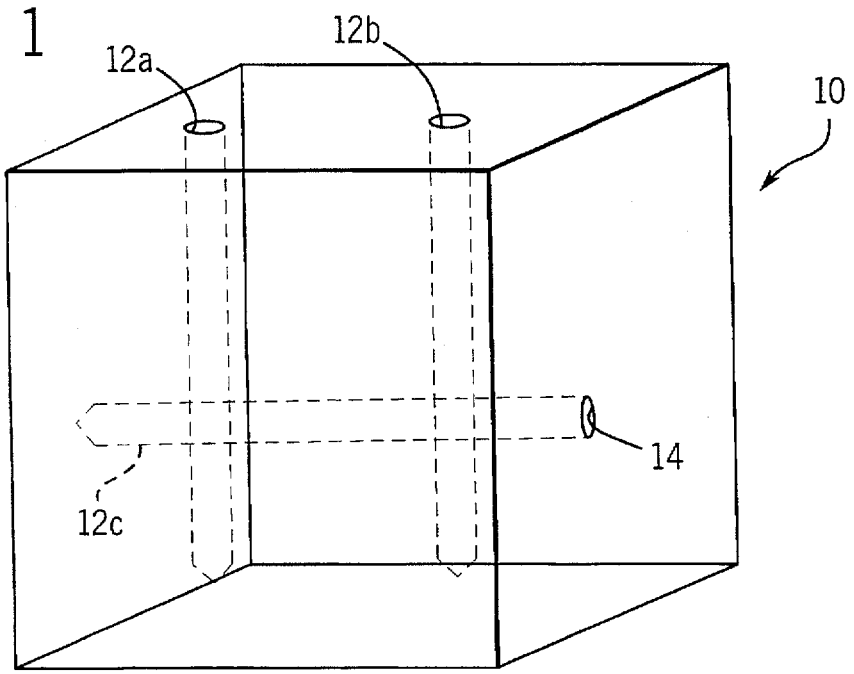
FIG. 1 illustrates a typical cooling block upon which the method of the present invention is practiced.

In FIG. 1, a cooling block is shown and generally designated as 10. Cooling block 10 defines internal channels 12*a*, 12*b*, 12*c*. Channels 12*a*, 12*b*, 12*c* are formed in block 10 by any conventional process, such as casting or drilling. Channels 12*a*, 12*b*, 12*c* may extend either partially or fully through block 10. In the manufacture of block 10, typically at least one cross channel such as channel 12*c* must be drilled once the casting process for creating block 10 is complete. Cross channel 12*c* is used to interconnect channels 12*a* and 12*b*, thus allowing fluid communication between the two. This channel forming process to interconnect internal channels 12*a* and 12*b* results in the formation of at least one aperture 14 in the surface of block 10. Other similar apertures (not shown) may also be present depending on the process used to form the channels. Therefore, before a cooling fluid (not shown) can be circulated within block 10, aperture 14 must be sealed to prevent leakage.

Figure 2:
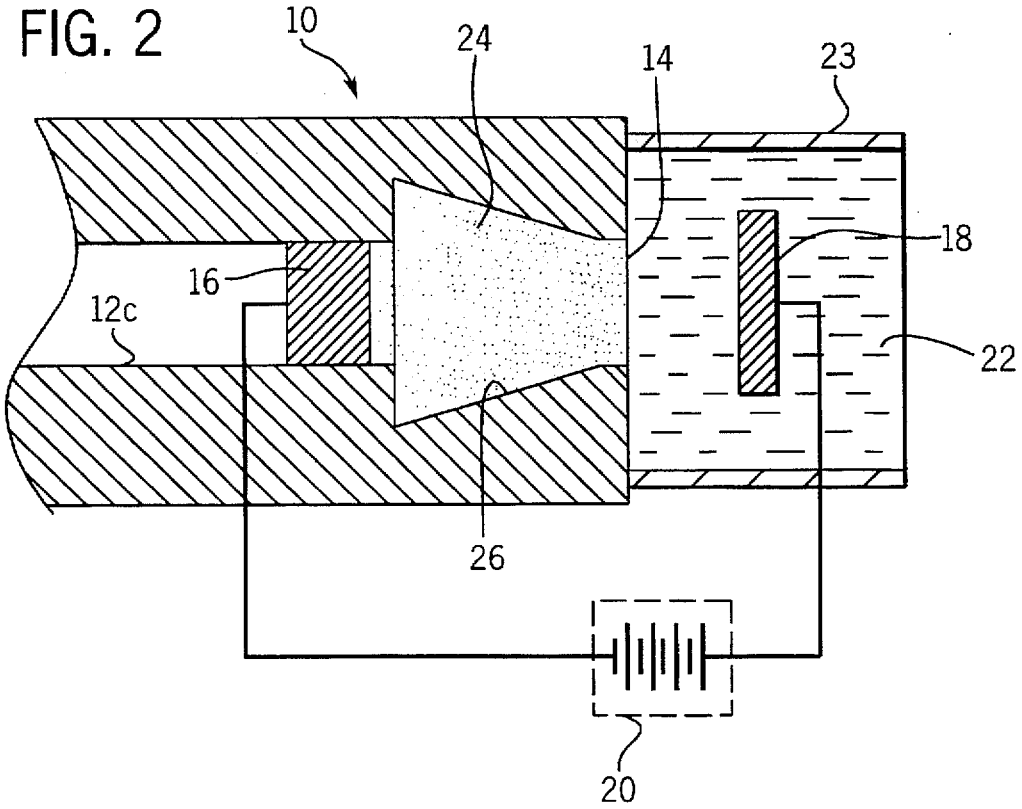
FIG. 2 illustrates an electrodepositing apparatus used in practicing the method of the present invention to seal an aperture in the cooling block of FIG. 1.

The method of the present invention electrodeposits material to seal openings such as aperture 14. Referring to FIG. 2, plug 16 is inserted into channel 12*c* such that plug 16 is recessed below the surface of block 10. Plug 16 can be fabricated of any standard material, although preferably plug 16 is made of the same material as block 10, e.g. copper. Attached adjacent to plug 16 is an anode plate 18. Anode plate 18 is electrically connected to the positive terminal of power source 20. Similarly, plug 16 is electrically connected to the negative terminal of power source 20 such that a partial electrical circuit is formed. To complete the electrical circuit, an aqueous solution 22 containing metallic ions is dispersed between plug 16 and anode 18 such that plug 18 functions as a cathode and a potential is created across plug 16 and anode 18. Aqueous solution 22 can be contained between plug 16 and anode 18 using any standard means such as walled structure 23. Alternatively, the portion of block 10 containing aperture 14 can be immersed in a bath of aqueous solution containing appropriate ions. Best results are usually achieved when the metallic ions in aqueous solution 22 are the same as the metal of cooling block 10. In a preferred embodiment, cooling block 10 is cast copper and aqueous solution 22 is a copper sulfate solution. When power source 20 creates a potential across anode 18 and plug 16, ions within solution 22 migrate toward plug 16 and are deposited on the external surface of plug 16. This process is continued until the recess adjacent plug 16 is filled with material 24, i.e., the deposited ions.

In one embodiment, a wedge-shaped cavity 26 is formed adjacent aperture 14 within channel 12*c* such that electrodeposited material 24 is prevented from blowing out when pressured by the fluid circulating within internal channels 12*a*, 12*b*, 12*c*. In another embodiment, the recess of channel 12*c* may be threaded (not shown) such that the threads act to decrease the possibility of a blowout of material 24.

Figure 3:
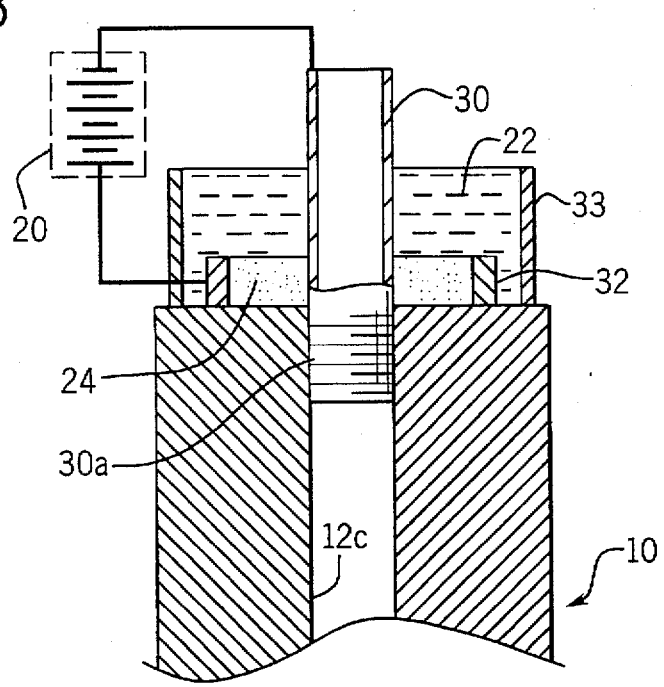
FIG. 3 illustrates the method of the present invention being used to bond a typical pipe fitting into an aperture of the cooling block of FIG. 1.

FIG. 3 illustrates another use for the method of this invention. In FIG. 3, cooling block 10 is provided with a standard pipe fitting 30 which is threadingly engaged within channel 12*c*. Because threads 30*a* of fitting 30 generally do not provide sufficient mechanical strength, it is desirable to provide additional means for securing pipe fitting 30 to cooling block 10. The electrodepositing method of the present invention is useful in this regard because material 24 can be deposited around and, depending upon the fit of channel 12*c* and fitting 30, in the joint without damaging either fitting 30 or block 10, while at the same time providing a seamless joint between fitting 30 and deposited material 24. Specifically, anode 32 is positioned adjacent the joint between fitting 30 and block 10. In this configuration, fitting 30 is utilized as a cathode, and thus fitting 30 is electrically connected to the negative terminal of power source 20. Aqueous solution 22 is dispersed between the outer surface of fitting 30 and anode 32 such that a potential is created across anode 32 and fitting 30, permitting material 24 to be deposited around the joint between block 10 and fitting 30. Again, aqueous solution 22 can be contained between fitting 30 and anode 32 using any standard means such as walled structure 33. Alternatively, the portion of block 10 containing fitting 30 can be immersed in a bath of aqueous solution. The electrodepositing process is continued until the desired amount of material 24 is deposited around the joint of block 10 and fitting 30. Again, aqueous solution 22 can be contained between fitting 30 and anode 32 using any standard means such as walled structure 33. Alternatively, the portion of block 10 containing fitting 30 can be immersed in a solution of metallic ions. The electrodepositing process is continued until the desired amount of material 24 is deposited around the joint of block 10 and fitting 30.

Figure 4:
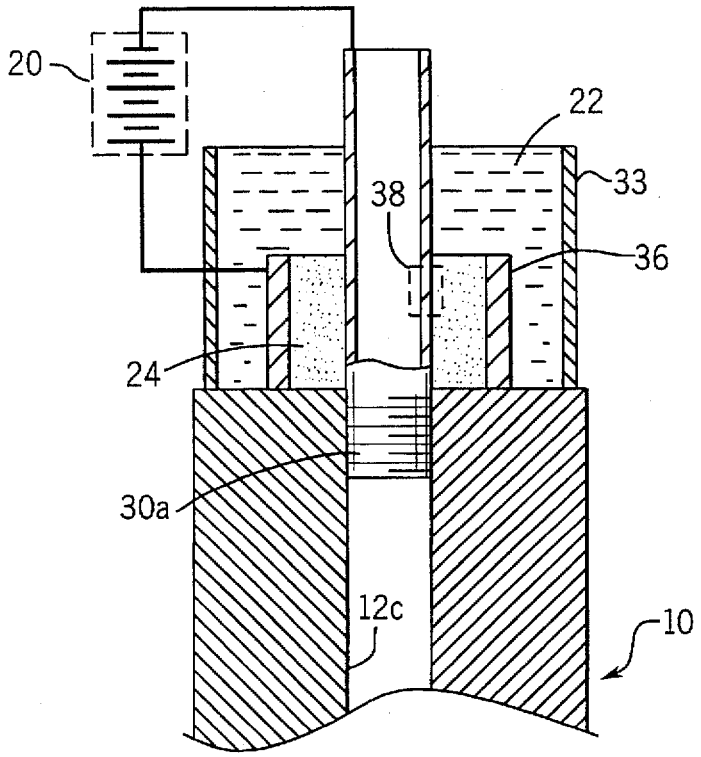
FIG. 4 illustrates the method of the present invention being used to repair a leak in a pipe fitting extending from the cooling block of FIG. 1.

FIG. 4 illustrates the method of this invention in the repair of ruptured or weakened areas 38 along pipe fitting 30. Again, anode 36 is used to deposit material 24 on the surface of fitting 30 which functions as a cathode. The process is continued until material 24 is deposited over damaged area 38 on pipe fitting 30. In a preferred embodiment, pipe fitting 30, cooling block 10 and deposited material 24 are all the same metal such that a seamless bond is formed between these parts.

Those skilled in the art will understand that the electrodepositing method described above can be used with materials other than copper and can be used to plug holes in other types of cooling blocks as well as other devices in which holes are required to be plugged.

Although the invention has been described in considerable detail through the figures and above discussion, many variations and modifications can be made by one skilled in the art without departing from the spirit of the invention as described in the following claims.

What is claimed is:

1. A method of sealing a channel opening in an outer surface of a metallic cooling block, the method comprising the steps of:

A. Inserting a mechanical plug having an external surface into the channel opening such that a recess is formed between the external surface of the plug and the outer surface of the cooling block;

B. Positioning an anode adjacent the recess;

C. Providing an aqueous solution containing metallic ions between the anode and the mechanical plug; and D. Creating an electric potential across the anode and the mechanical plug such that metal is deposited upon the external surface of the plug to fill the recess and form a seamless seal with the outer surface of the cooling block.

2. The method of claim 1 in which the cooling block and plug are made of copper and the aqueous solution is copper sulfate.

3. A method of sealing an opening in an outer surface of a pyrometallurgical furnace component, the method comprising the steps of:

A. Inserting a mechanical plug into the opening such that a recess is formed between an external surface of the plug and the outer surface of the pyrometallurgical furnace component;

B. Positioning an anode adjacent the opening;

C. Providing an aqueous solution containing metallic ions between the anode and the mechanical plug; and D. Creating an electric potential across the anode and the mechanical plug such that metal is deposited upon the external surface of the plug to fill the recess and form a seamless seal with the outer surface of the pyrometallurgical furnace component.

4. The method of claim 3 comprising the additional step of boring a wedge-shaped cavity in the recess below the outer surface of the component.

5. The method of claim 3 comprising the additional step of threading the recess below the outer surface of the component.

* * * * *